US010549150B2

(12) United States Patent
Chen et al.

(10) Patent No.: US 10,549,150 B2
(45) Date of Patent: Feb. 4, 2020

(54) MULTIFUNCTIONAL ABDOMINAL EXERCISE WHEEL

(71) Applicant: Taizhou Huangyan Ankang Fitness Equipment Co., Ltd., Taizhou, Zhejiang (CN)

(72) Inventors: Jian Chen, Zhejiang (CN); Xiaoben Zhang, Zhejiang (CN)

(73) Assignee: TAIZHOU HUANGYAN ANKANG FITNESS EQUIPMENT CO., LTD., Taizhou, Zhejiang (CN)

( * ) Notice: Subject to any disclaimer, the term of this patent is extended or adjusted under 35 U.S.C. 154(b) by 81 days.

(21) Appl. No.: 16/061,510

(22) PCT Filed: Jun. 13, 2017

(86) PCT No.: PCT/CN2017/088108
§ 371 (c)(1),
(2) Date: Jun. 12, 2018

(87) PCT Pub. No.: WO2017/215597
PCT Pub. Date: Dec. 21, 2017

(65) Prior Publication Data

US 2019/0151708 A1 May 23, 2019

(30) Foreign Application Priority Data

Jun. 17, 2016 (CN) ..... 2016 2 0601679 U

(51) Int. Cl.
*A63B 22/20* (2006.01)
*A63B 21/02* (2006.01)
(Continued)

(52) U.S. Cl.
CPC ..... *A63B 22/20* (2013.01); *A63B 21/0004* (2013.01); *A63B 21/00069* (2013.01);
(Continued)

(58) Field of Classification Search
CPC . A63B 22/20; A63B 71/0619; A63B 21/0435; A63B 71/0669; A63B 22/201;
(Continued)

(56) References Cited

U.S. PATENT DOCUMENTS 2,821,394 A * 1/1958 Barbeau ..... A63B 21/0618 482/132
3,752,475 A * 8/1973 Ott ..... A63B 21/0004 482/127

(Continued)

FOREIGN PATENT DOCUMENTS

CN 103153407 A 6/2013
CN 203483788 U 3/2014

(Continued)

*Primary Examiner* — Garrett K Atkinson
(74) *Attorney, Agent, or Firm* — Muncy, Geissler, Olds & Lowe, P.C.

(57) ABSTRACT

The present invention discloses a multifunctional abdominal exercise wheel, comprising a main body, support members, a central pipe fitting, and a spring barrel. Two ends of the central pipe fitting are each provided with a support rotating member. The support rotating member is pivoted to a support member. The central pipe fitting is inserted into the spring barrel and fixed. The spring barrel is provided with a power spring. The main body is fixedly provided with a single-chip microcomputer, and a display apparatus, a sensor, and a button separately electrically connected to the single-chip microcomputer. Therefore, motion data can be displayed, the stroke and resistance of the abdominal exercise wheel can be adjusted, torsion outputs are stable, and springback noise is small.

6 Claims, 6 Drawing Sheets

(51) Int. Cl.

| | |
|---|---|
| ***A63B 21/00*** | (2006.01) |
| ***A63B 71/06*** | (2006.01) |
| ***A63B 23/035*** | (2006.01) |
| ***A63B 21/04*** | (2006.01) |
| ***A63B 21/045*** | (2006.01) |
| ***A63B 21/22*** | (2006.01) |
| ***A63B 23/02*** | (2006.01) |
| ***A63B 23/00*** | (2006.01) |
| ***A63B 71/00*** | (2006.01) |

(52) U.S. Cl.

CPC ..... *A63B 21/025* (2013.01); *A63B 21/0435* (2013.01); *A63B 21/0455* (2013.01); *A63B 21/22* (2013.01); *A63B 21/4035* (2015.10); *A63B 21/4045* (2015.10); *A63B 22/201* (2013.01); *A63B 23/0211* (2013.01); *A63B 23/0355* (2013.01); *A63B 23/03525* (2013.01); *A63B 71/0619* (2013.01); *A63B 71/0669* (2013.01); *A63B 71/0686* (2013.01); *A63B 2023/006* (2013.01); *A63B 2071/0072* (2013.01); *A63B 2071/0081* (2013.01); *A63B 2071/065* (2013.01); *A63B 2071/0658* (2013.01); *A63B 2208/0219* (2013.01); *A63B 2220/803* (2013.01); *A63B 2230/75* (2013.01)

(58) Field of Classification Search

CPC ..... A63B 23/0355; A63B 23/03525; A63B 21/0004; A63B 21/4045; A63B 71/0686; A63B 21/00069; A63B 21/025; A63B 23/0211; A63B 21/22; A63B 21/0455; A63B 21/4035; A63B 2071/0081; A63B 2208/0219; A63B 2071/0072; A63B 2023/006; A63B 2071/0658; A63B 2220/803; A63B 2230/75; A63B 2071/065

See application file for complete search history.

(56) References Cited

U.S. PATENT DOCUMENTS

| | | | | | |
|---|---|---|---|---|---|
| 4,618,142 | A * | 10/1986 | Joseph, Jr. | A63B 5/20 | 482/106 |
| 5,261,866 | A * | 11/1993 | Mattox | A63B 21/0552 | 482/125 |
| 6,017,296 | A * | 1/2000 | Tang | A63B 22/20 | 482/127 |
| 6,146,318 | A * | 11/2000 | Kuo | A63B 21/0004 | 482/132 |
| 6,196,955 | B1 * | 3/2001 | Chuang | A63B 21/0004 | 482/127 |
| 6,254,518 | B1 * | 7/2001 | Yu | A63B 21/0004 | 482/132 |
| 6,264,587 | B1 * | 7/2001 | Lee | A63B 22/20 | 252/62.3 R |
| 6,328,680 | B1 * | 12/2001 | Shifferaw | A63B 21/0618 | 482/127 |
| 6,348,027 | B1 * | 2/2002 | Lee | A63B 21/0004 | 482/127 |
| 6,354,983 | B1 * | 3/2002 | Lee | A63B 21/023 | 482/127 |
| 6,409,639 | B1 * | 6/2002 | Kuo | A63B 21/0004 | 482/132 |
| 6,503,179 | B2 * | 1/2003 | Miraflor | A63B 21/023 | 446/78 |
| 6,585,627 | B2 * | 7/2003 | Fernandez | A63B 21/0004 | 482/132 |
| 6,638,201 | B1 * | 10/2003 | Dischler | A63B 22/20 | 482/132 |
| 7,935,035 | B2 * | 5/2011 | Smith | A63B 21/0004 | 482/110 |
| 8,708,874 | B2 * | 4/2014 | Chen | A63B 21/0004 | 482/110 |
| 9,011,303 | B2 * | 4/2015 | MacColl | A63B 21/0004 | 482/127 |
| 9,808,665 | B1 * | 11/2017 | Demarais | A63B 21/4035 | |
| 10,004,942 | B1 * | 6/2018 | Huang | A63B 22/20 | |
| 10,046,198 | B1 * | 8/2018 | Huang | A63B 23/1236 | |
| 2002/0025894 | A1 * | 2/2002 | Fernandez | A63B 21/0004 | 482/140 |
| 2002/0128130 | A1 * | 9/2002 | Miraflor | A63B 21/023 | 482/141 |
| 2003/0050153 | A1 * | 3/2003 | Stevens | A63B 21/025 | 482/92 |
| 2003/0134726 | A1 * | 7/2003 | Yu | A63B 21/00043 | 482/110 |
| 2005/0202944 | A1 * | 9/2005 | Deal | A61H 15/0092 | 482/126 |
| 2008/0167168 | A1 * | 7/2008 | Hurst | A63B 21/0728 | 482/132 |
| 2009/0247375 | A1 * | 10/2009 | Smith | A63B 21/0004 | 482/110 |
| 2013/0017936 | A1 * | 1/2013 | Olson | A63B 21/0004 | 482/132 |
| 2019/0134447 | A1 * | 5/2019 | Chiang | A63B 21/0004 | |

FOREIGN PATENT DOCUMENTS

| | | | |
|---|---|---|---|
| CN | 204293765 | U | 4/2015 |
| CN | 205198832 | U | 5/2016 |
| CN | 105920795 | A | 9/2016 |
| CN | 205683480 | U | 11/2016 |
| KR | 20020079312 | A | 10/2002 |

* cited by examiner

MULTIFUNCTIONAL ABDOMINAL EXERCISE WHEEL

FIELD OF THE INVENTION

The present invention relates to an exercising device, and in particular, to a multifunctional abdominal exercise wheel.

BACKGROUND OF THE INVENTION

As people become more conscious of exercise, more small-sized exercising devices are widely used because they enable people to do exercises and body shaping indoors. As an exercising device for exercising the abdominal muscles, an abdominal exercise wheel enables people to do aerobics exercises and local limb coordination anytime and anywhere, like after the busy work or in a small room space. An existing abdominal exercise wheel is disclosed in Patent No. 201510939554.2, and comprises: a roller, grips, outer casings, a bearing bar, and a spring. The grips are fixedly connected to the roller. The roller is formed by two pieces of outer casings screwed to each other. The bearing bar is fixedly connected in a cavity groove of the outer casings. The grips are sleeved over two ends of the bearing bar. The spring is fixedly connected in a cavity of the roller. The spring is a torsion spring. The roller is oval-shaped. In this way, a user may sway the body left and right without being injured, to fully exercise the muscles on both sides of the body. With the torsion spring, the exercise purpose may be achieved to some extent. However, the torsion spring has a large size, and torsion outputs are not stable. In addition, there are not functions of counting times and recording consumed calories, nor resistance adjustment and stroke adjustment functions, making it difficult to meet requirements of users at different exercise stages.

SUMMARY OF THE INVENTION

The objective of the present invention is to provide a multifunctional abdominal exercise wheel, which has functions of displaying motion times and consumed calories, can adjust a rotation stroke of the abdominal exercise wheel, to prevent an unnecessary facial injury caused by an uncontrolled motion, and can also adjust rotation resistance of the abdominal exercise wheel, to adjust load according to an exercise stage of an exerciser. In addition, torsion outputs of a spring are stable, and springback noise is small. Therefore, requirements of users at different exercise stages can be met.

To achieve the foregoing objective, a main technical solution in the present invention is providing a multifunctional abdominal exercise wheel, comprising: a main body, support members, a central pipe fitting, support rotating members, handles, a spring barrel, a power spring, a buffer member, a stroke fixing member, a stroke locating member, a stroke compressive member, a sensor, a single-chip microcomputer, a display apparatus, a button, and a fixing member. The central pipe fitting is inserted into a round hole in the middle of the spring barrel. The round hole in the middle of the spring barrel is screwed to the middle of the central pipe fitting. The power spring is disposed in the spring barrel. An outer end of the power spring is fixed on an inner wall of the spring barrel. The central pipe fitting is sequentially inserted into round holes in the middle of the main body and the stroke fixing member. The main body is pivoted to the central pipe fitting. The stroke fixing member is fixedly connected to the central pipe fitting. Two support rotating members are respectively sleeved over two ends of the central pipe fitting. The inside of the support rotating members is screwed to the central pipe fitting. The handles are screwed to tail ends of the central pipe fitting. Outer sides of the left and right support rotating members are each pivoted to a support member. Inner sides of the two support members are respectively screwed to the left and right sides of the main body. An inner end of the power spring is fixed on the main body. Beneficial effects are as follows: During exercising using the abdominal exercise wheel, when a motion component rotates outward, the power spring forms a rotating torque to store energy; when the motion component rotates inward, the power spring releases energy, making it easier to rotate, and effectively lowering use difficulty for beginners.

A spiral groove is formed on a side of the main body close to the stroke fixing member. The buffer member is mounted on an outer end of the spiral groove. The stroke fixing member is provided with a slideway hole. The stroke locating member passes through the slideway hole and extends to the outer end of the spiral groove. The stroke compressive member and the stroke fixing member correspond to the same slideway hole and are fixedly connected, so that the stroke locating member is slidably locked in the slideway hole. When the handles are grabbed to rotate forward on the floor by using the abdominal exercise wheel, the stroke fixing member does not rotate but the main body rotates, so that the stroke locating member slides in the spiral groove from the outer end to an inner end, and slides in the slideway hole of the stroke fixing member from the outer side to the inner side. When the stroke locating member gets stuck after sliding to the inner end of the spiral groove, the abdominal exercise wheel stops rotating forward. When the abdominal exercise wheel rotates backward on the floor, the stroke locating member slides in the spiral groove from the inner end to the outer end, and slides in the slideway hole of the stroke fixing member from the inner side to the outer side. When the stroke locating member touches the buffer member and gets stuck after sliding to the outer end of the spiral groove, the abdominal exercise wheel stops rotating backward. Beneficial effects are as follows: The buffer member can perform a buffer action when the stroke locating member touches the spiral groove of the main body, reducing noise during springback of the power spring.

During resistance adjustment of the abdominal exercise wheel, the stroke compressive member is detached, the stroke locating member is removed, and the main body is rotated relative to the handles, to deform the power spring to some extent. Then the stroke locating member passes through the slideway hole and extends to the outer end of the spiral groove, and the stroke locating member is slidably locked in the slideway hole of the stroke fixing member by using the stroke compressive member. Beneficial effects are as follows: The abdominal exercise wheel can adjust the resistance, and meet strength requirements of different users at different exercise stages.

During stroke adjustment of the abdominal exercise wheel, the stroke compressive member is detached, the stroke locating member is removed out of the outer end of the spiral groove, and inserted in an inside groove of the spiral groove, and is slidably locked in the slideway hole of the stroke fixing member by using the stroke compressive member. The length of an inward sliding track of the stroke locating member in the spiral groove is in a positive correlation to a rotation distance of the abdominal exercise wheel. Beneficial effects are as follows: The abdominal exercise wheel can adjust the stroke, and meet requirements of different users on the length of the rotation stroke of the abdominal exercise wheel.

An anti-slip member is fixed on the support member. Beneficial effects are as follows: Friction between the abdominal exercise wheel and the floor increases, preventing the abdominal exercise wheel from slipping. In addition, abrasions on the abdominal exercise wheel are reduced, prolonging the service life.

The main body is fixedly provided with the sensor. The sensor is disposed close to the spiral groove on a side of the main body, and can sense a motion of the stroke locating member in the section of the spiral groove. A groove is formed on an outer side of the main body. The single-chip microcomputer electrically connected to the sensor and the display apparatus and the button separately electrically connected to the single-chip microcomputer are disposed in the groove by using the fixing member. During exercising using the abdominal exercise wheel, the stroke locating member also slides back and forth between the inner end and outer end of the spiral groove. When the motion is sensed by the sensor, the sensor sends an electrical signal to the single-chip microcomputer. After receiving the electrical signal, the single-chip microcomputer processes the electrical signal and transmits data to the display apparatus. The data on the display apparatus may be cleared by pressing the button. Beneficial effects are as follows: Motion times and consumed calories can be displayed.

Tail ends of the handles are fixedly provided with labels. Beneficial effects are as follows: With the labels printed to indicate the left and right sides, the front side of the abdominal exercise wheel can be determined quickly during use, to read the motion data on the display apparatus.

In the Figures: 1: Label, 2: Handle, 3: Main body, 4: Anti-slip member, 5: Support member, 6: Support rotating member, 7: Spring barrel, 8: Power spring, 9: Central pipe fitting, 10: Single-chip microcomputer, 11: Fixing member, 12: Button, 13: Sensor, 14: Spiral groove, 15: Buffer member, 16: Stroke fixing member, 17: Stroke locating member, 18: Stroke compressive member, 19: Display apparatus, and 20: Slideway hole.

DETAILED DESCRIPTION OF THE INVENTION

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention shall fall within the protection scope of the present invention.

Figure 1:
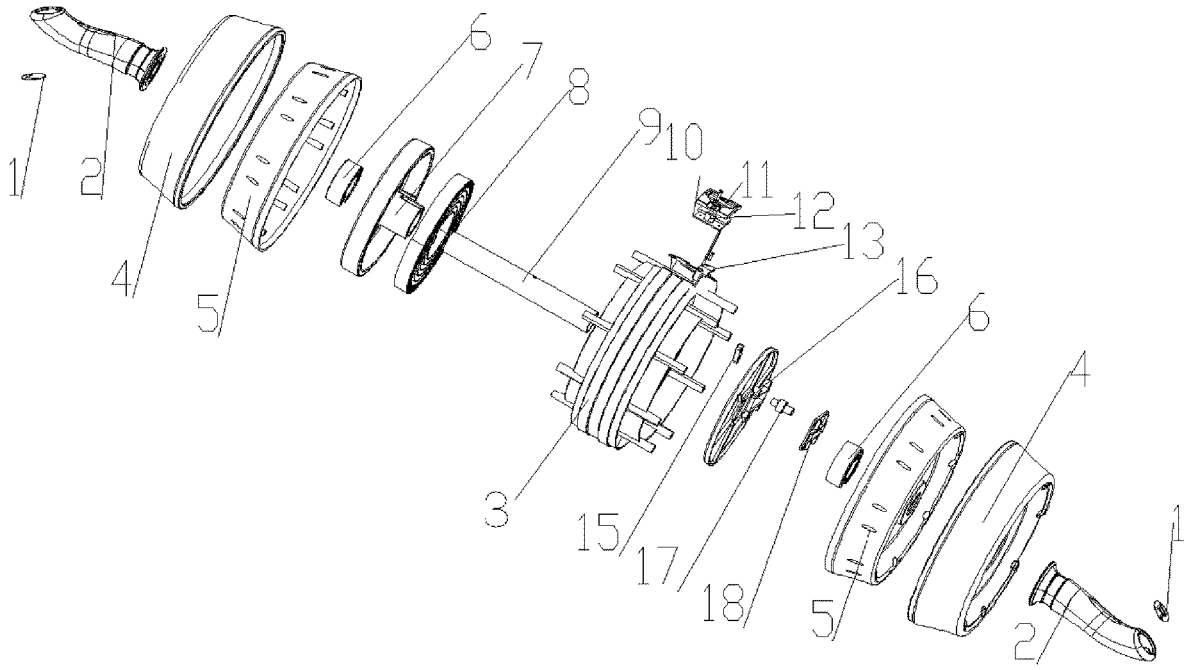
FIG. 1 is a schematic exploded structural diagram according to an embodiment of the present invention.
Figure 2:
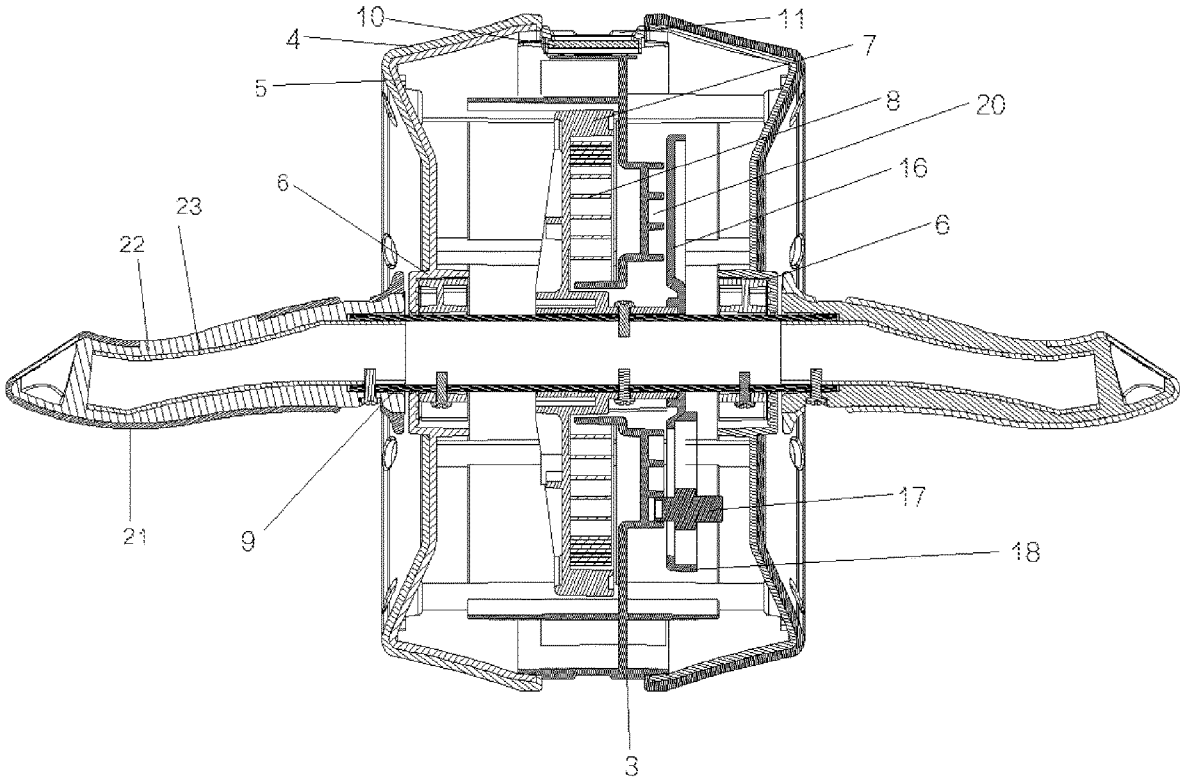
FIG. 2 is a front cutaway drawing according to an embodiment of the present invention.
Figure 3:
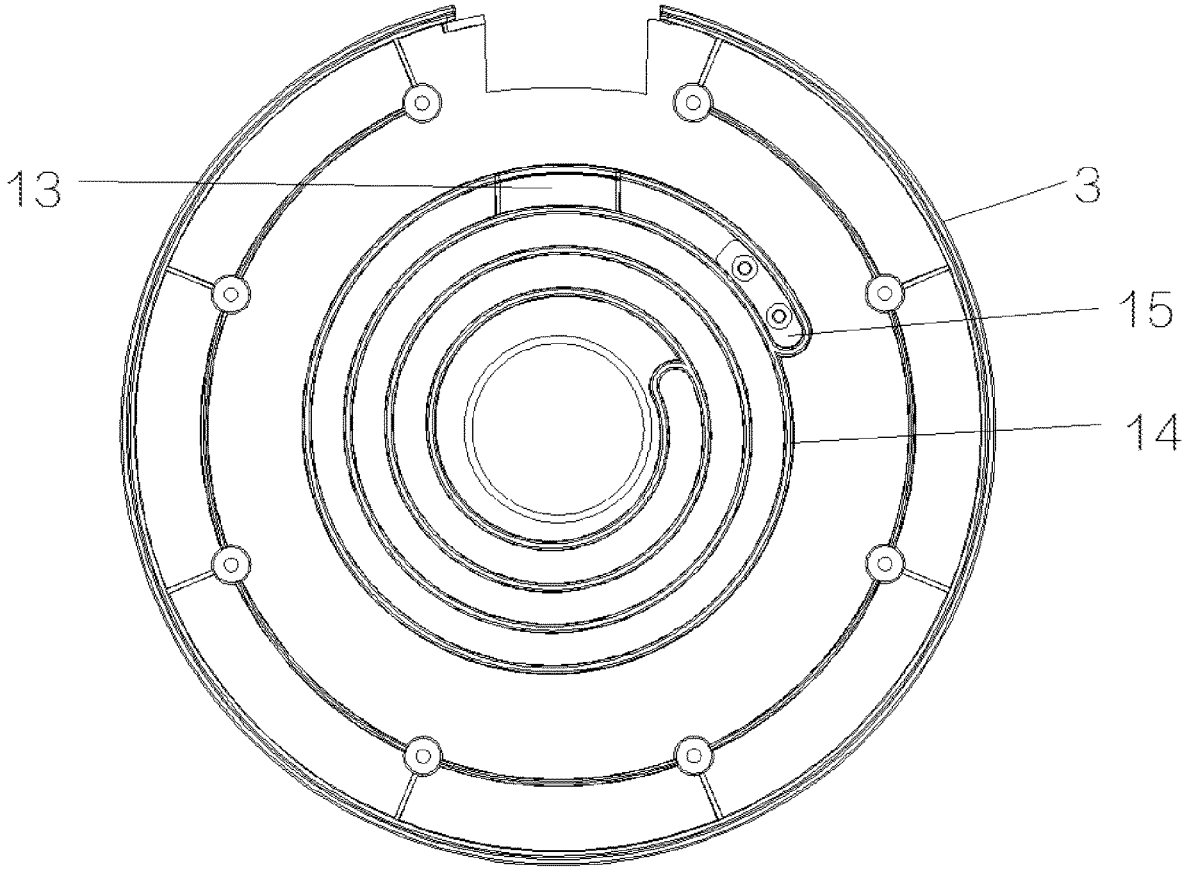
FIG. 3 is a schematic structural diagram of a side face of the main body according to the present invention.
Figure 4:
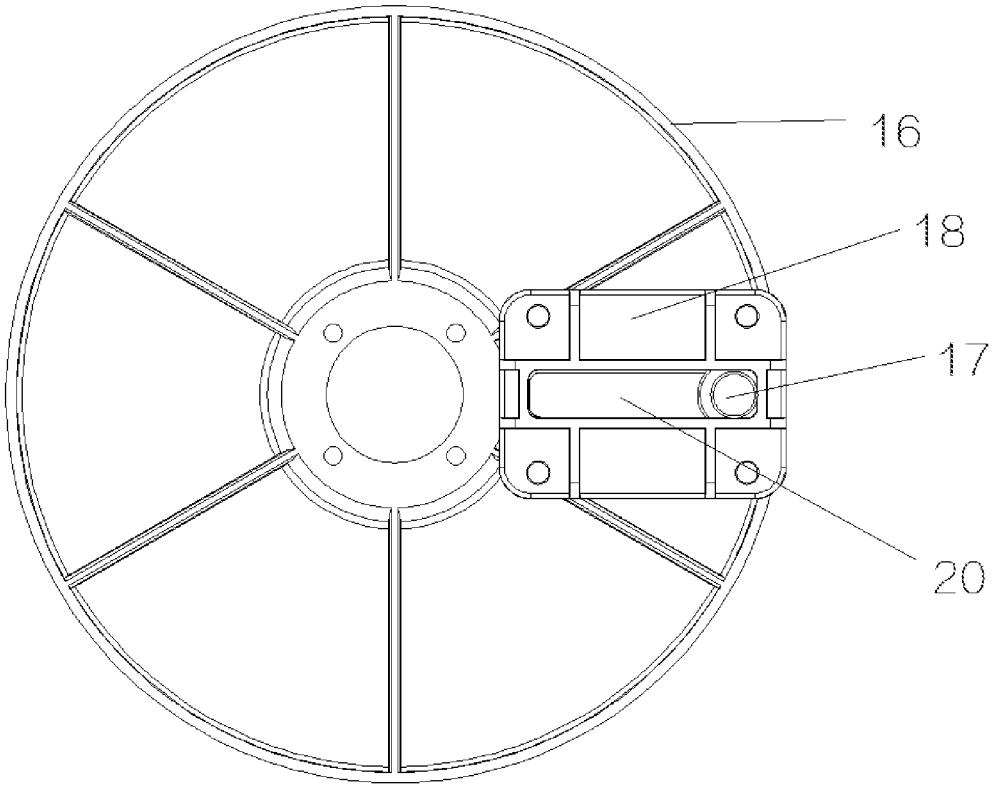
FIG. 4 is a front structural diagram of the stroke fixing member, the stroke locating member, and the stroke compressive member according to the present invention.
Figure 5:
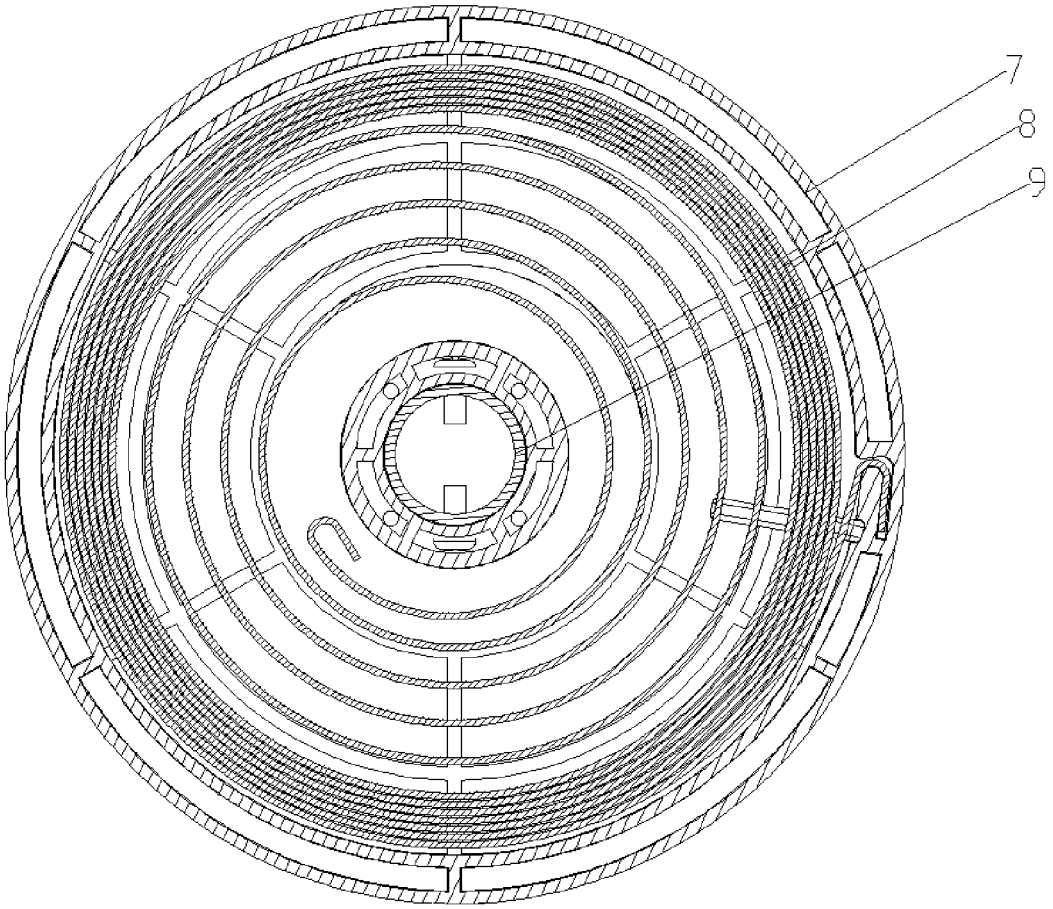
FIG. 5 is a front structural diagram of the spring barrel and the power spring according to the present invention.
Figure 6:
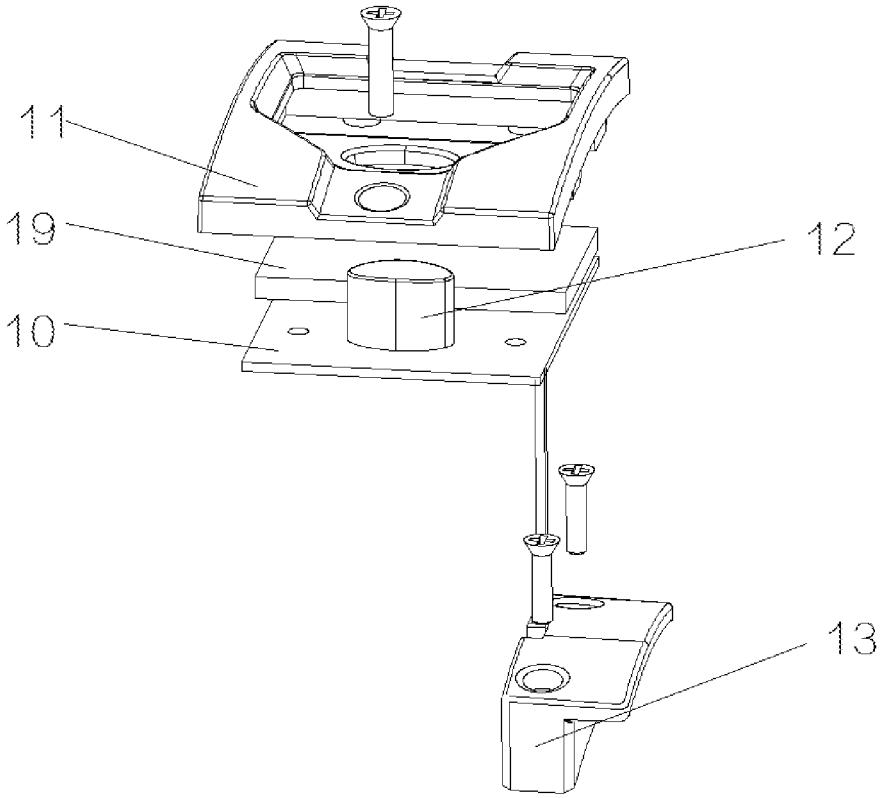
FIG. 6 is a schematic amplified diagram of the sensor, the single-chip microcomputer, and the display apparatus in the exploded diagram according to the present invention.

As shown in FIG. 1, a multifunctional abdominal exercise wheel described in an embodiment comprises: a main body 3, support members 5, a central pipe fitting 9, support rotating members 6, handles 2, a spring barrel 7, a power spring 8, a buffer member 15, a stroke fixing member 16, a stroke locating member 17, a stroke compressive member 18, a sensor, a single-chip microcomputer 10, a display apparatus 19, a button 12, and a fixing member 11. The central pipe fitting 9 is inserted into a round hole in the middle of the spring barrel 7. The round hole in the middle of the spring barrel 7 is screwed to the middle of the central pipe fitting 9. The power spring 8 is disposed in the spring barrel 7. An outer end of the power spring 8 is fixed on an inner wall of the spring barrel 7. The central pipe fitting 9 is sequentially inserted into round holes in the middle of the main body 3 and the stroke fixing member 16. The main body 3 is pivoted to the central pipe fitting 9. The stroke fixing member 16 is fixedly connected to the central pipe fitting 9. Two support rotating members 6 are respectively sleeved over two ends of the central pipe fitting 9. The inside of the support rotating members 6 is screwed to the central pipe fitting 9. The handles 2 are screwed to tail ends of the central pipe fitting 9. Outer sides of the left and right support rotating members 6 are each pivoted to a support member 5. Inner sides of the two support members 5 are respectively screwed to the left and right sides of the main body 3. An inner end of the power spring 8 is fixed on the middle of the main body 3. During exercising using the abdominal exercise wheel, when a motion component rotates outward, the power spring 8 forms a rotating torque to store energy; when the motion component rotates inward, the power spring 8 releases energy, making it easier to rotate, and effectively lowering use difficulty for beginners.

A spiral groove 14 is formed on a side of the main body 3 close to the stroke fixing member 16. The buffer member 15 is mounted on an outer end of the spiral groove 14. The stroke fixing member 16 is provided with a slideway hole 20. The stroke locating member 17 passes through the slideway hole 20 and extends to the outer end of the spiral groove 14. The stroke compressive member 18 and the stroke fixing member correspond to the same slideway hole 20 and are fixedly connected, so that the stroke locating member 17 is slidably locked in the slideway hole 20. When the handles 2 are grabbed to rotate forward on the floor by using the abdominal exercise wheel, the stroke fixing member 16 does not rotate but the main body 3 rotates, so that the stroke locating member 17 slides in the spiral groove 14 from the outer end to an inner end, and slides in the slideway hole 20 of the stroke fixing member 16 from the outer side to the inner side. When the stroke locating member 17 gets stuck after sliding to the inner end of the spiral groove 14, the abdominal exercise wheel stops rotating forward. When the abdominal exercise wheel rotates backward on the floor, the stroke locating member 17 slides in the spiral groove 14 from the inner end to the outer end, and slides in the slideway hole 20 of the stroke fixing member 16 from the inner side to the outer side. When the stroke locating member touches the buffer member 15 and gets stuck after sliding to the outer end of the spiral groove 14, the abdominal exercise wheel stops rotating backward. The buffer member 15 can perform a buffer action when the stroke locating member 17 touches the spiral groove 14 of the main body 3, reducing noise during springback of the power spring 8.

During resistance adjustment of the abdominal exercise wheel, the stroke compressive member 18 is detached, the stroke locating member 17 is removed, and the main body 3 is rotated relative to the handles 2, to deform the power spring 8 to some extent. Then the stroke locating member 17 passes through the slideway hole 20 and extends to the outer end of the spiral groove 14, and the stroke locating member 17 is slidably locked in the slideway hole of the stroke fixing member 16 by using the stroke compressive member 18. The abdominal exercise wheel can adjust the resistance, and meet strength requirements of different users at different exercise stages.

During stroke adjustment of the abdominal exercise wheel, the stroke compressive member 18 is detached, the stroke locating member 17 is removed out of the outer end of the spiral groove 14, and inserted in an inside groove of the spiral groove 14, and is slidably locked in the slideway hole 20 of the stroke fixing member 16 by using the stroke compressive member 18. The length of an inward sliding track of the stroke locating member 17 in the spiral groove 14 is in a positive correlation to a rotation distance of the abdominal exercise wheel. The abdominal exercise wheel can adjust the stroke, and meet requirements of different users on the length of the rotation stroke of the abdominal exercise wheel.

An anti-slip member 4 is fixed on the support member 5. Friction between the abdominal exercise wheel and the floor increases, preventing the abdominal exercise wheel from slipping. In addition, abrasions on the abdominal exercise wheel are reduced, prolonging the service life.

The main body 3 is fixedly provided with the sensor 13. The sensor 13 is disposed close to the spiral groove 14 on a side of the main body 3, and can sense a motion of the stroke locating member 17 in the section of the spiral groove 14. A groove is formed on an outer side of the main body 3. The single-chip microcomputer 10 electrically connected to the sensor 13 and the display apparatus 19 and the button separately electrically connected to the single-chip microcomputer 10 are disposed in the groove by using the fixing member 11. During exercising using the abdominal exercise wheel, the stroke locating member 17 also slides back and forth between the inner end and outer end of the spiral groove 14. When the motion is sensed by the sensor 13, the sensor 13 sends an electrical signal to the single-chip microcomputer 10. After receiving the electrical signal, the single-chip microcomputer 10 processes the electrical signal and transmits data to the display apparatus 19. The data on the display apparatus 19 may be cleared by pressing the button. Motion times and consumed calories can be displayed.

Tail ends of the handles 2 are fixedly provided with labels 1. With the labels 1 printed to indicate the left and right sides, the front side of the abdominal exercise wheel can be determined quickly during use, to read the motion data on the display apparatus 19.

The present invention is not limited to the foregoing preferred implementations. Any person may obtain products in various other forms based on the revelations of the present invention. Regardless of any change on shapes or structures, technical solutions the same as or similar to those in this application shall fall within the protection scope of the present invention.

The invention claimed is:

1. A multifunctional abdominal exercise wheel, comprising: a main body (3), support members (5), a central pipe fitting (9), handles (2), and support rotating members (6), wherein the two ends of the central pipe fitting (9) are each fixedly provided with one of the support rotating members (6), the handles (2) are fixedly mounted on tail ends of the central pipe fitting (9), at least one of the support rotating members (6) is pivoted to a support member (5), and the support member (5) is fixedly connected to the main body (3), wherein the abdominal exercise wheel further comprises a spring barrel (7), a power spring (8), and a stroke fixing member (16), wherein the central pipe fitting (9) is inserted into the middle of the spring barrel (7) and fixed, the power spring (8) is disposed in the spring barrel (7), an outer end of the power spring (8) is fixed on the spring barrel (7), the central pipe fitting (9) is inserted into the stroke fixing member (16) and fixed, and an inner end of the power spring (8) is fixed on the main body (3).

2. The multifunctional abdominal exercise wheel according to claim 1, wherein a spiral groove (14) is formed on a side of the main body (3) close to the stroke fixing member (16).

3. The multifunctional abdominal exercise wheel according to claim 2, wherein a buffer member (15) is mounted on an outer end of the spiral groove (14).

4. The multifunctional abdominal exercise wheel according to claim 1, wherein the stroke fixing member (16) is provided with a slideway hole (20), a stroke locating member (17) passes through the slideway hole (20) and extends to the outer end of the spiral groove (14), and stroke compressive member (18) and the stroke fixing member correspond to the slideway hole (20) and are fixedly connected, so that the stroke locating member (17) is slidably locked in the slideway hole (20).

5. The multifunctional abdominal exercise wheel according to claim 1, wherein a groove is formed on an outer side of the main body (3), a single-chip microcomputer (10) electrically connected to a sensor (13) is fixed in the groove, a display apparatus (19) and a button (12) separately electrically connected to the single-chip microcomputer are fixed on the single-chip microcomputer (10), and a fixing member (11) is fixed on the display apparatus (19) and the button (12).

6. The multifunctional abdominal exercise wheel according to claim 1, wherein tail ends of the handles (2) are fixedly provided with labels (1).

* * * * *